US010202725B1

(12) United States Patent
Chin

(10) Patent No.: US 10,202,725 B1
(45) Date of Patent: Feb. 12, 2019

(54) WAVE-SHAPED RAMP

(71) Applicant: T. K. CHIN COMPANY LTD., Taipei (TW)

(72) Inventor: Howard Chin, Taipei (TW)

(73) Assignee: T. K. CHIN COMPANY LTD., Taipei (TW)

( * ) Notice: Subject to any disclaimer, the term of this patent is extended or adjusted under 35 U.S.C. 154(b) by 0 days.

(21) Appl. No.: 15/839,846

(22) Filed: Dec. 12, 2017

(30) Foreign Application Priority Data

Oct. 20, 2017 (TW) ..... 106136237 A

(51) Int. Cl.
*A63C 19/10* (2006.01)
*E01C 13/00* (2006.01)

(52) U.S. Cl.
CPC ..... *E01C 13/003* (2013.01); *A63C 19/10* (2013.01)

(58) Field of Classification Search
CPC ..... A63C 10/00; A63C 19/10; E01C 13/00; E01C 13/003
USPC ..... 472/88–90; 14/69.5, 71.1, 72.5; 104/275–277
See application file for complete search history.

(56) References Cited

U.S. PATENT DOCUMENTS 6,654,977 B1 * 12/2003 Chin ..... A63C 19/10 14/69.5
8,196,244 B2 * 6/2012 Mapp ..... E01C 13/003 14/69.5
8,288,652 B2 * 10/2012 Lubanski ..... H02G 9/025 104/275
9,675,869 B1 * 6/2017 Chin ..... A63C 19/10

* cited by examiner

*Primary Examiner* — Kien Nguyen
(74) *Attorney, Agent, or Firm* — Hershkovitz & Associates, PLLC; Abe Hershkovitz

(57) ABSTRACT

A wave-shaped ramp has two ascending platforms and a curved platform. Each ascending platform has a ground end, a tip end, and a slope. The tip end is higher than the ground end. The slope connects the ground end and the tip end. The curved platform is mounted between the two ascending platforms. Two ends of the curved platform are higher than a middle of the curved platform. With the curved platform forming a cavity shape between the two ascending platforms, the wave-shaped ramp provides more varieties in height, and thereby the player can perform more fancy stunts on the wave-shaped ramp. Besides, the wave-shaped ramp is a combination of the ascending platforms and the curved platform, so the wave-shaped ramp is separable and is capable of being stacked for storage.

14 Claims, 11 Drawing Sheets

WAVE-SHAPED RAMP

CROSS-REFERENCE TO RELATED APPLICATIONS

This application is based upon and claims priority under 35 U.S.C. 119 from Taiwan Patent Application No. 106136237 filed on Oct. 20, 2017, which is hereby specifically incorporated herein by this reference thereto.

BACKGROUND OF THE INVENTION

1. Field of the Invention

The present invention relates to sports equipment, especially to extreme sport equipment.

2. Description of the Prior Arts

Extreme sport is a good choice for someone who likes adventures and exciting sports. When doing the extreme sport, the player dives and accelerates to leap from the ground. Following that, the player falls at very high speed to the ground. During the extreme sport, the player experiences the thrill generated by the variations of the acceleration and the freefall. In order to leap and slide during the extreme sport, the player may get assistance with a platform.

In other words, with the platform varying in height, the player is able to perform a lot of different fancy stunts, combining the athletic and the aesthetic. However, the conventional jumping ramp comprises two slopes disposed back to back and connected with each other on tops of the slopes by a plane surface. In such a structure, a top portion of the conventional jumping ramp lacks variations in height, so the actions that are performed on the top portion of the conventional jumping ramp are the same as the actions that are performed on the ground. Therefore, the actions lack diversities.

To overcome the shortcomings, the present invention provides a wave-shaped ramp to mitigate or obviate the aforementioned problems.

SUMMARY OF THE INVENTION

The main objective of the present invention is to provide a wave-shaped ramp that has variations in height.

The wave-shaped ramp has two ascending platforms and a curved platform. Each ascending platform has a ground end, a tip end, and a slope. The tip end is higher than the ground end. The slope is a top surface of the ascending platform and connects the ground end and the tip end. The curved platform is mounted between the two ascending platforms. Two ends of the curved platform are defined as two first linking ends connected with the tip ends of the two ascending platforms. The two ends of the curved platform are higher than a middle of the curved platform.

With the curved platform forming a cavity shape between the two ascending platforms, the wave-shaped ramp provides more variations in height, and thereby the player can perform more fancy stunts on the wave-shaped ramp. Besides, the wave-shaped ramp is a combination of the ascending platforms and the curved platform, so the wave-shaped ramp is separable and is capable of being stacked for storage.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
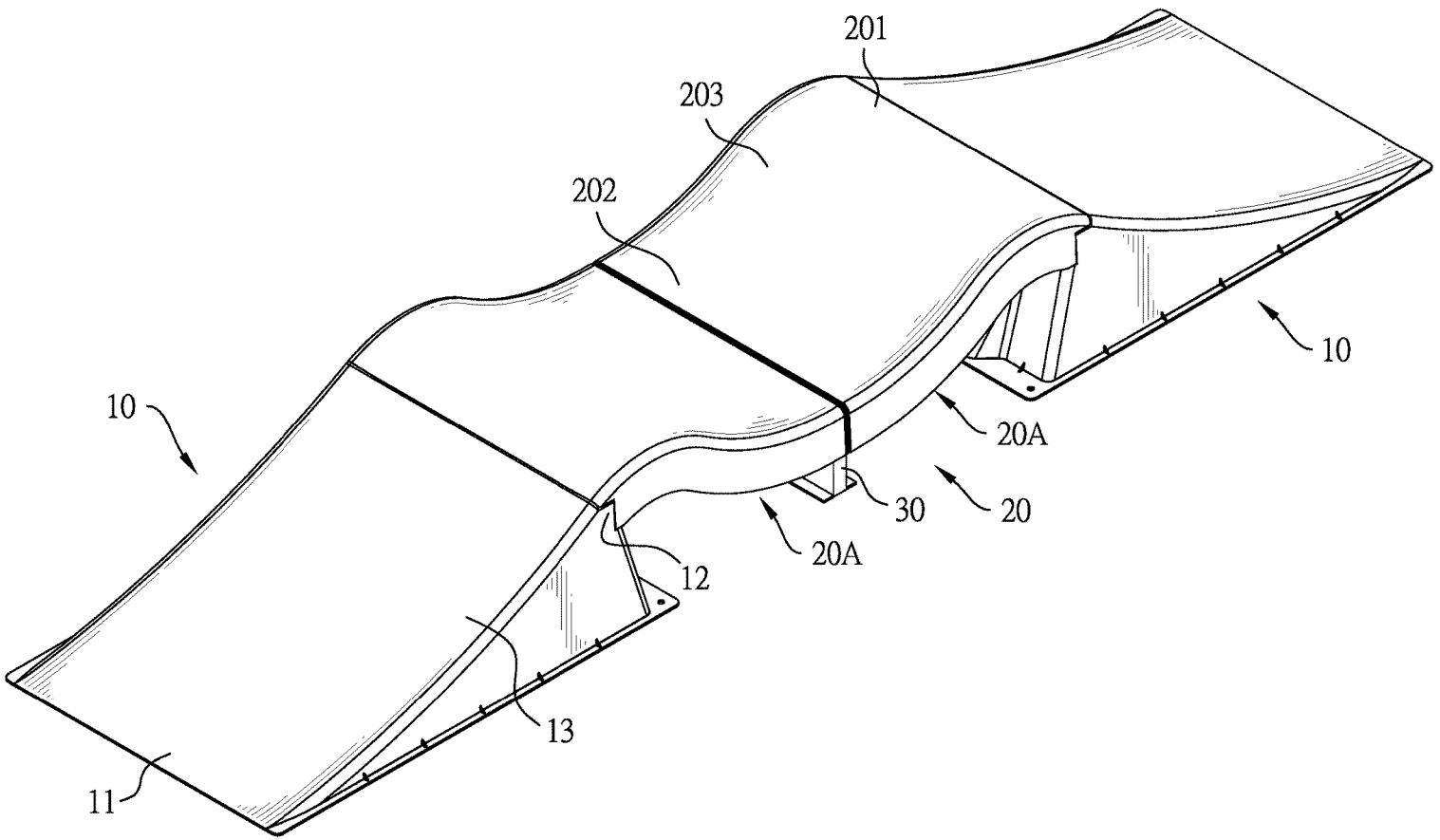
FIG. 1 is a perspective view of a wave-shaped ramp in accordance with the present invention.
Figure 2:
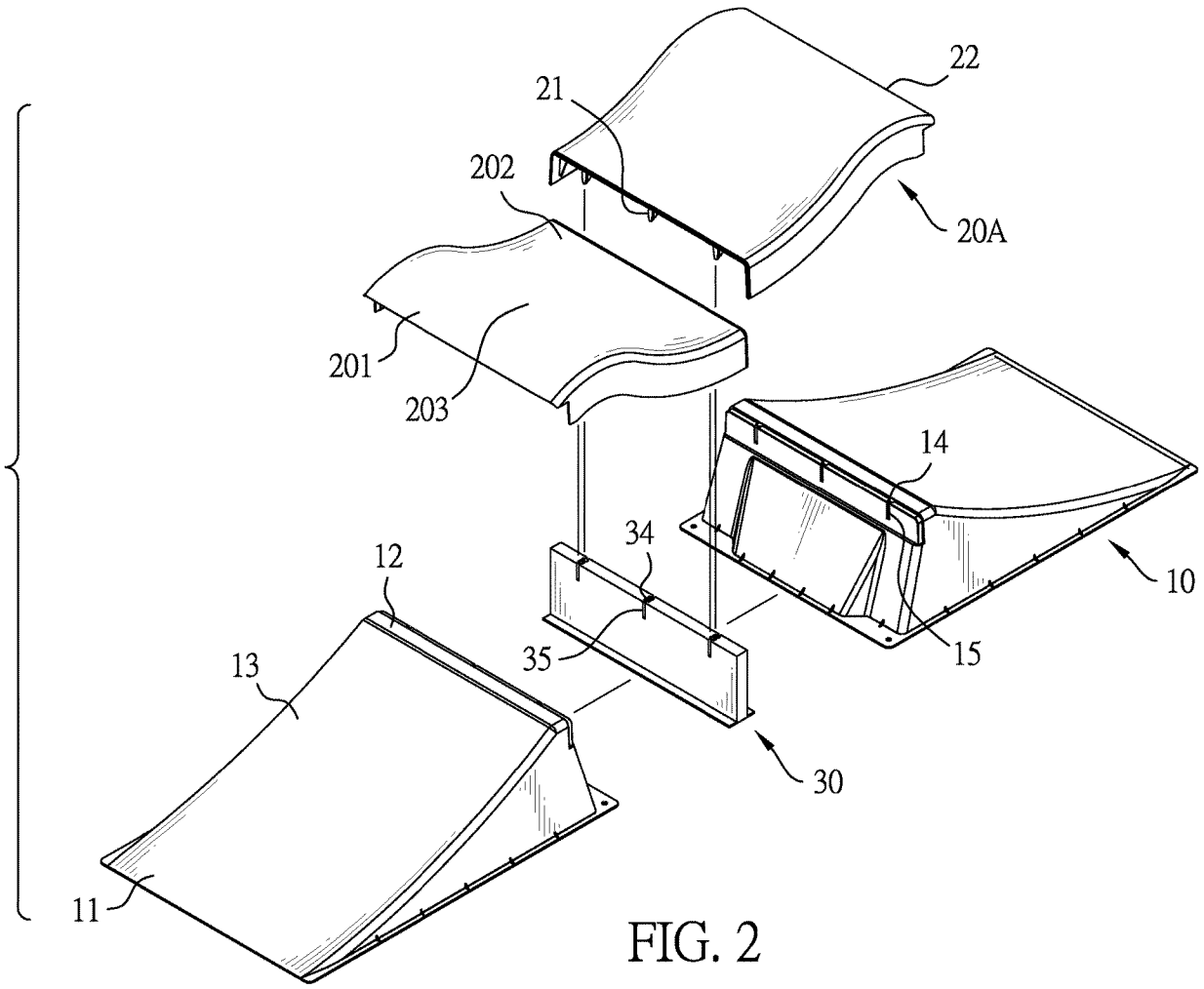
FIG. 2 is an exploded view of the wave-shaped ramp in FIG. 1.

Please refer to FIGS. 1 and 2 first. A wave-shaped ramp in accordance with the present invention is provided. The wave-shaped ramp comprises two ascending platforms 10, a curved platform 20, and a supporting portion 30. The curved platform 20 is mounted between the two ascending platforms 10, so that the wave-shaped ramp of the present invention provides variations in height via not only the ascending platforms 10, but also the curved platform 20. In addition, the height variations at the ascending platforms 10 are different from those of the curved platform 20, which allows an extreme sport player to perform more different stunts on the wave-shaped ramp of the present invention. To make a structural strength firmer, one end of the supporting portion 30 is securely mounted on a bottom surface of the curved platform 20 and another end of the supporting portion 30 abuts the ground. In other words, the supporting portion 30 is used for supporting the curved platform 20 and the player on the curved platform 20. The supporting portion 30 may extend in a lengthwise direction or a width direction of the wave-shaped ramp. The curved platform 20 and the supporting portion 30 may be made integrally, or as two separable parts. In another embodiment, the wave-shaped ramp of the present invention may not comprise the supporting portion 30.

Figure 3A:
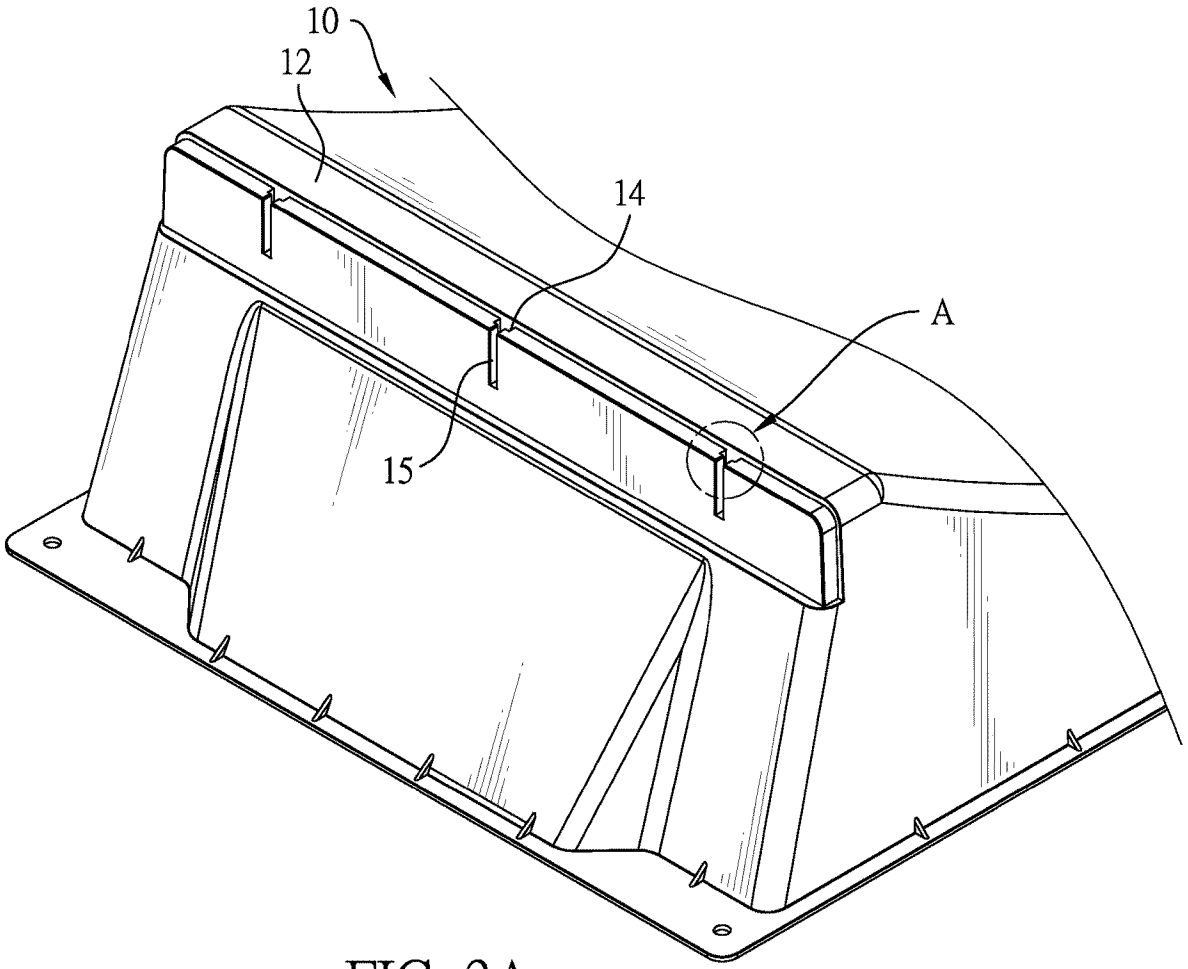
FIG. 3A is an enlarged view of an ascending platform of the wave-shaped ramp in FIG. 1.
Figure 3B:
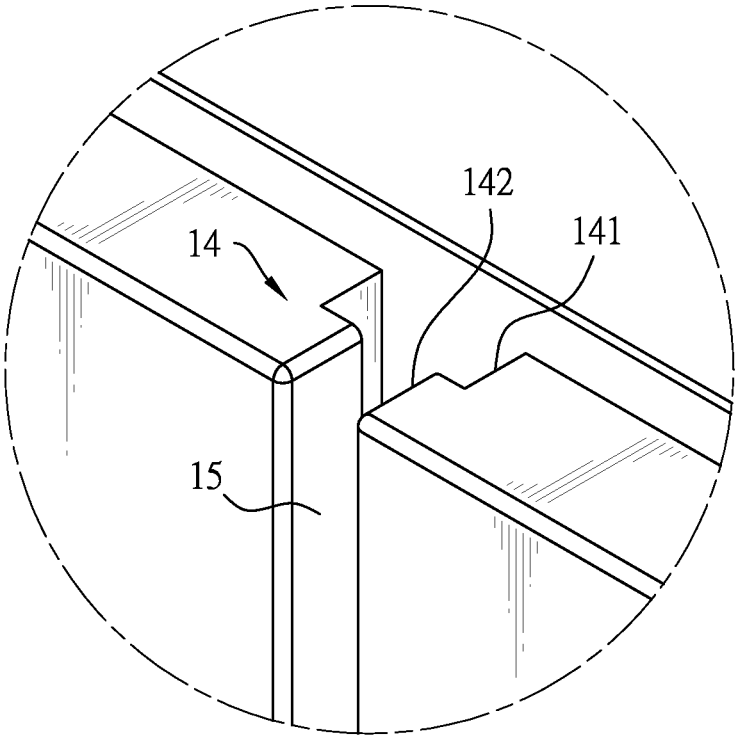
FIG. 3B is an enlarged view of an engaging groove of the ascending platform of the wave-shaped ramp in FIG. 3A.
Figure 4:
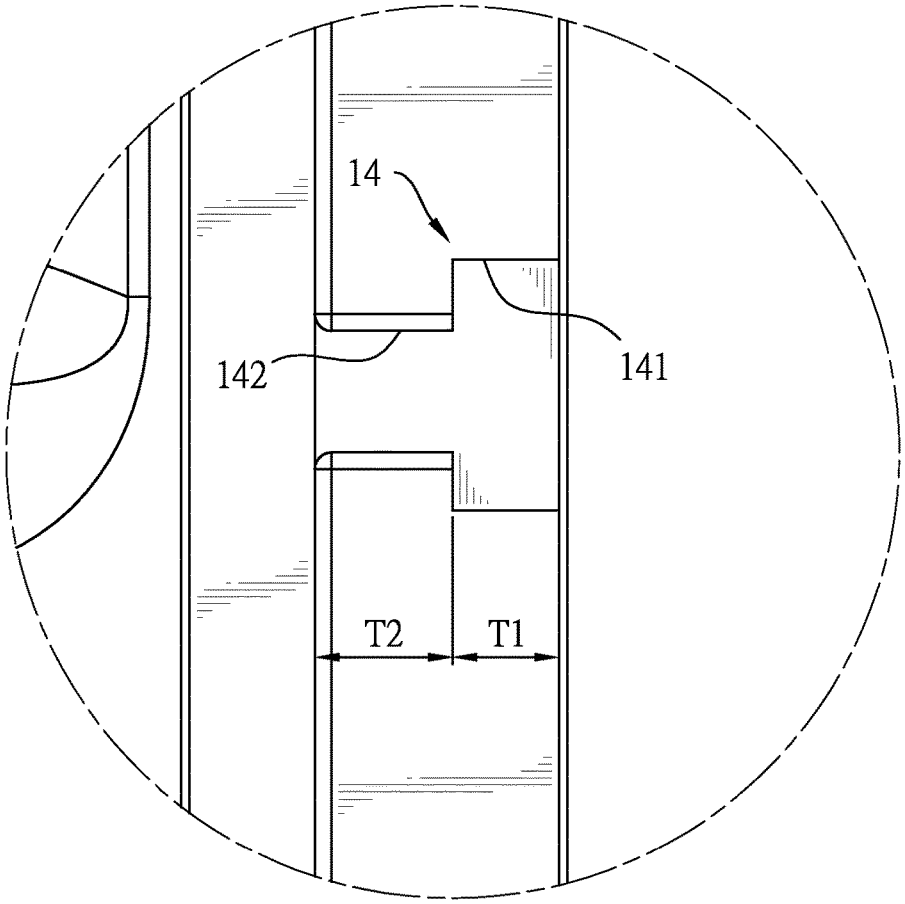
FIG. 4 is a top view of an engaging groove of the ascending platform of the wave-shaped ramp in FIG. 3A.

Then please also refer to FIGS. 3A, 3B, and 4. Each one of the ascending platforms 10 comprises a ground end 11, a tip end 12, and a slope 13. The tip end 12 is higher than the ground end 11. The slope 13 is a top surface of the ascending platform 10 and connects the ground end 11 and the tip end 12. In this embodiment, the slope 13 is a curved surface concaved downward, but a portion of the slope 13 near the ground end 11 is approximately horizontal so that the ground end 11 and the ground form a smooth surface. The smooth surface means there is no corner or gap on that surface. Each one of the ascending platforms 10 comprises at least one engaging groove 14. The at least one engaging groove 14 is formed on a top surface of the tip end 12 and extends downward from the top surface of the tip end 12. In this embodiment, each one of the ascending platforms 10 further comprises at least one slot 15. A number of the at least one slot 15 equals to a number of the at least one engaging groove 14 of each one of the ascending platforms 10. Each slot 15 is formed on a surface of the ascending platform 10 and said surface faces to the other ascending platform 10. Each slot 15 extends downward from the top surface of the tip end 12 and communicates with a respective one of the engaging grooves 14.

In each one of the engaging grooves 14 formed on the ascending platforms 10, a width of a portion of the engaging groove 14 near the ground end 11 of the corresponding ascending platform 10 is wider than a width of another portion of said engaging groove 14 away from said ground end 11 in a lengthwise direction of the wave-shaped ramp. Therefore, a horizontal cross section of each engaging groove 14 may be dovetail-shaped, wedge-shaped, or stepped. In this embodiment, the horizontal cross section of each engaging groove 14 is stepped in shape. Precisely, each engaging groove 14 of each ascending platform 10 forms a first space 141 and a second space 142. The second space 142 is farther from the ground end 11 of the corresponding ascending platform 10 (i.e., closer to the other ascending platform 10) than the first space 141. In the lengthwise direction of the wave-shaped ramp, a dimension of the second space 142 is larger than that of the first space 141. In other words, an interval T1 of the first space 141 is smaller than an interval T2 of the second space 142, which enhances the structural strength of the engaging groove 14. In this embodiment, each one of the second spaces 142 communicates with a respective one of the slots 15.

Figure 5:
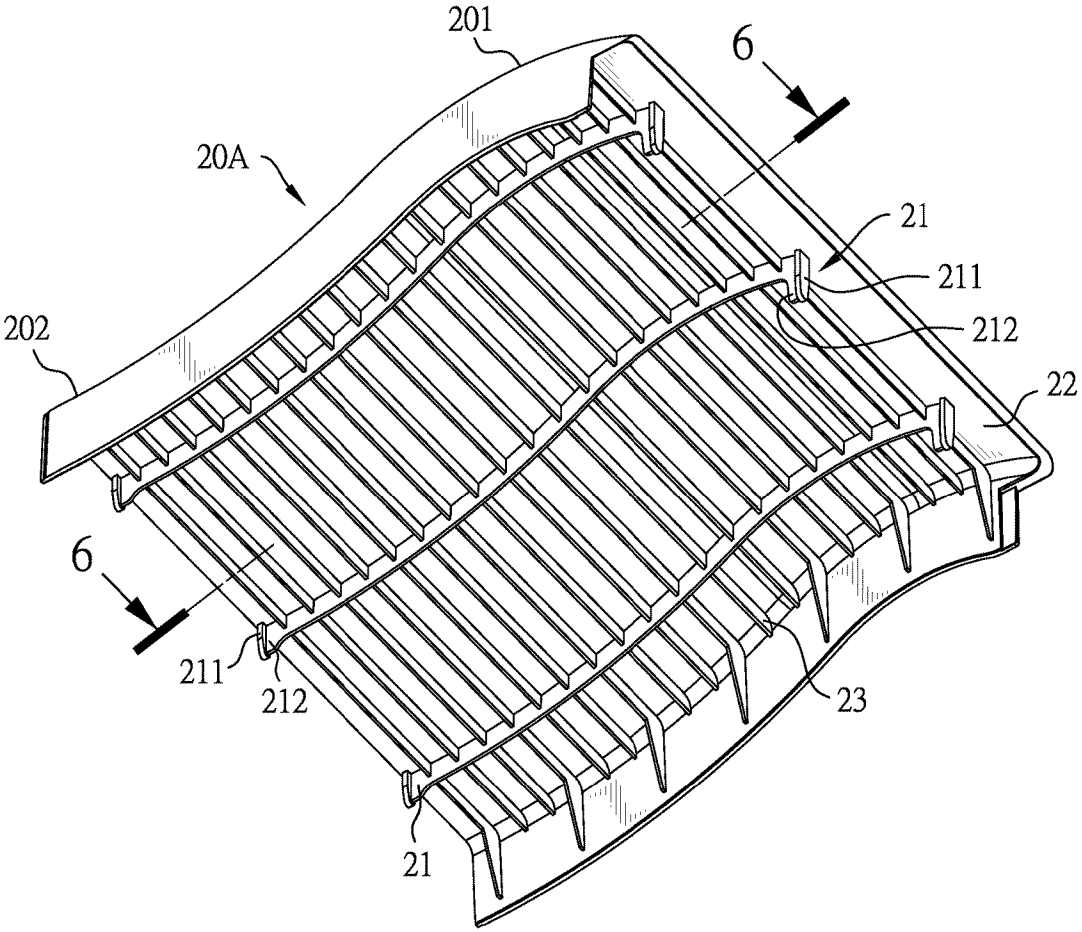
FIG. 5 is a perspective view of a curved portion of the wave-shaped ramp in FIG. 1.
Figure 6:
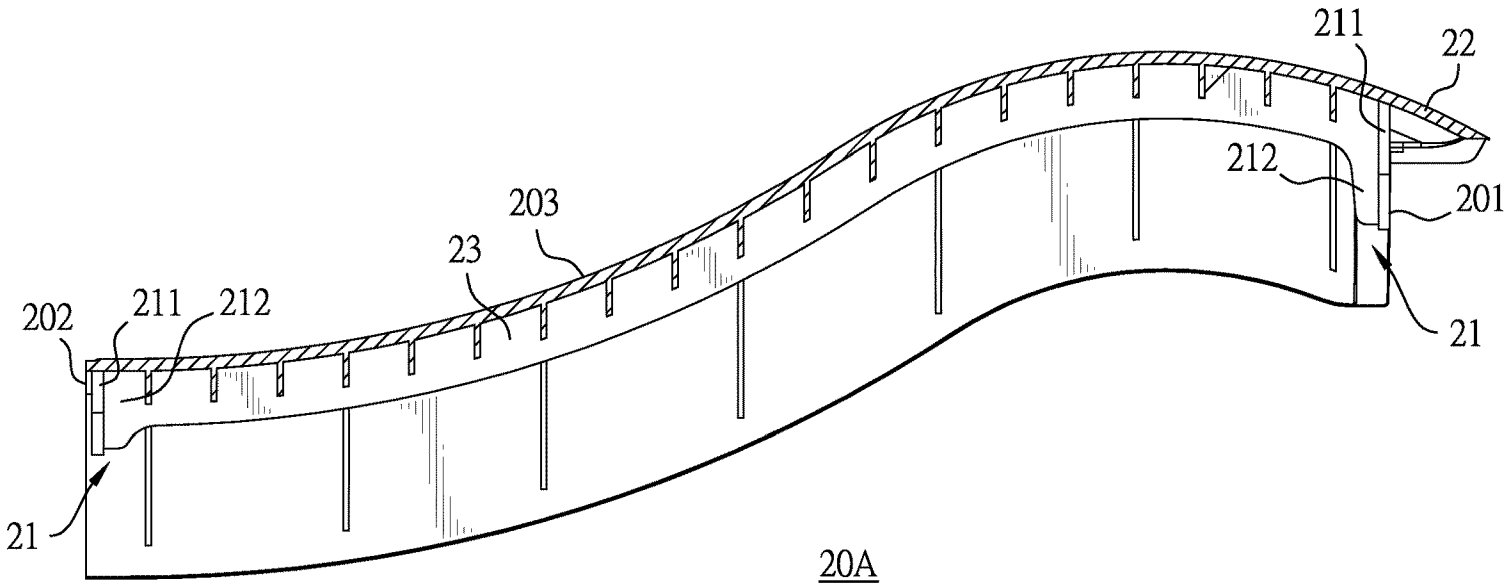
FIG. 6 is a sectional view of the curved portion of the wave-shaped ramp across line 6-6 in FIG. 5.

Then please refer to FIGS. 2, 5, and 6. Two ends of the curved platform 20 are defined as two first linking ends 201. The two first linking ends 201 are respectively connected with the tip ends 12 of the two ascending platforms 10. The two ends of the curved platform 20 are higher than a middle of the curved platform 20. The curved platform 20 comprises a plurality of engaging protrusions 21, two additional pieces 22, and a plurality of ribs 23.

The two additional pieces 22 are formed at the two first linking ends 201 of the curved platform 20 respectively and protrude in the lengthwise direction of the wave-shaped ramp. The two additional pieces 22 abut downward the tip ends 12 of the two ascending platforms 10 respectively. An upper surface of each one of the additional pieces 22 is part of a top surface of the curved platform 20. A gradient of each additional piece 22 and a gradient of the slope 13 of the corresponding ascending platform 10 are the same at a junction thereof, so said junction of the ascending platform 10 and the curved platform 20 forms a smooth surface.

Figure 7:
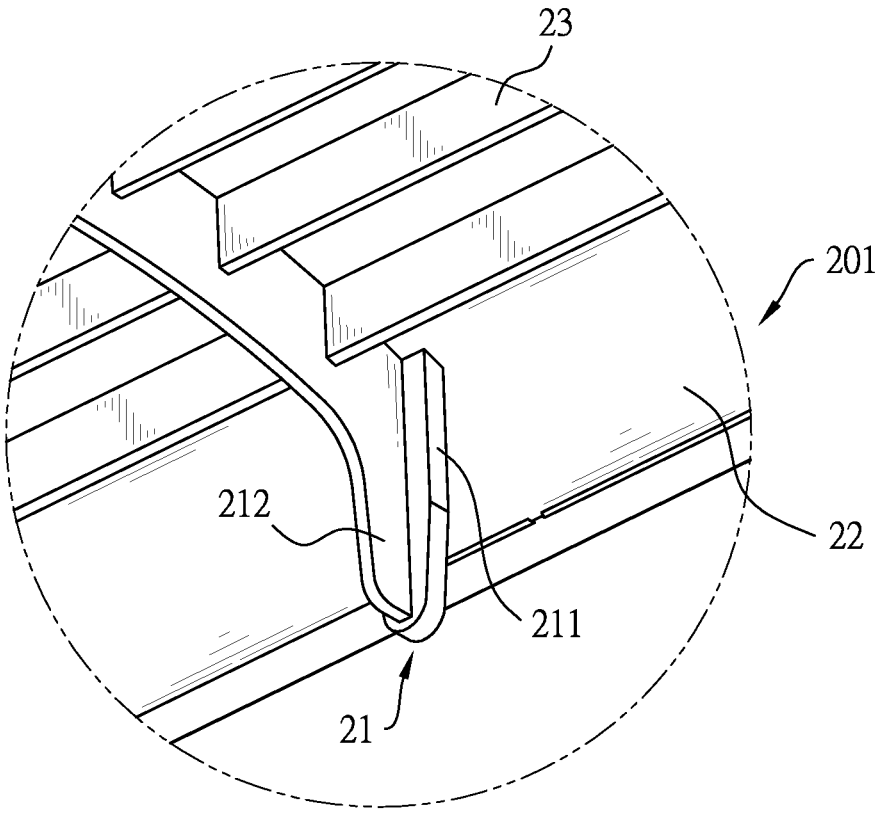
FIG. 7 is an enlarged view of a first linking end of the curved portion of the wave-shaped ramp in FIG. 5.
Figure 8:
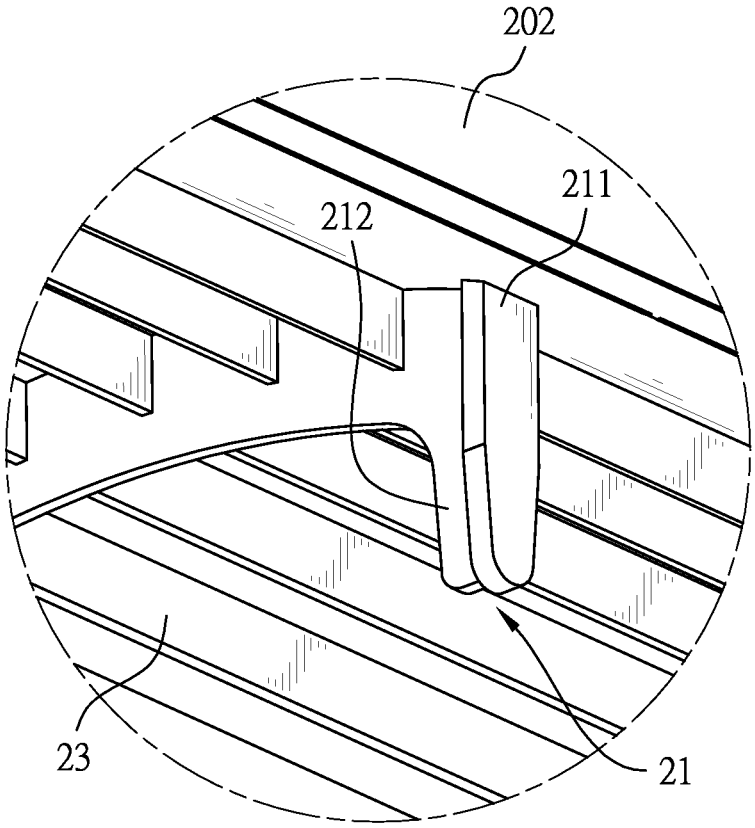
FIG. 8 is an enlarged view of a second linking end of the curved portion of the wave-shaped ramp in FIG. 5.
Figure 9A:
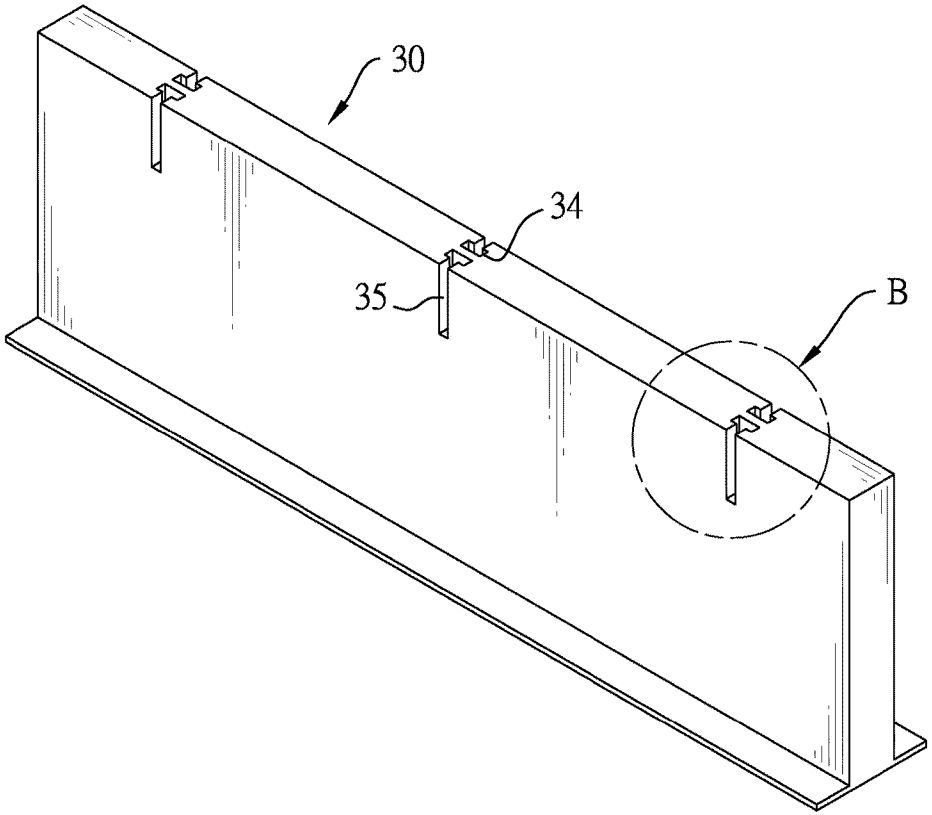
FIG. 9A is a perspective view of a supporting portion of the wave-shaped ramp in FIG. 1.
Figure 9B:
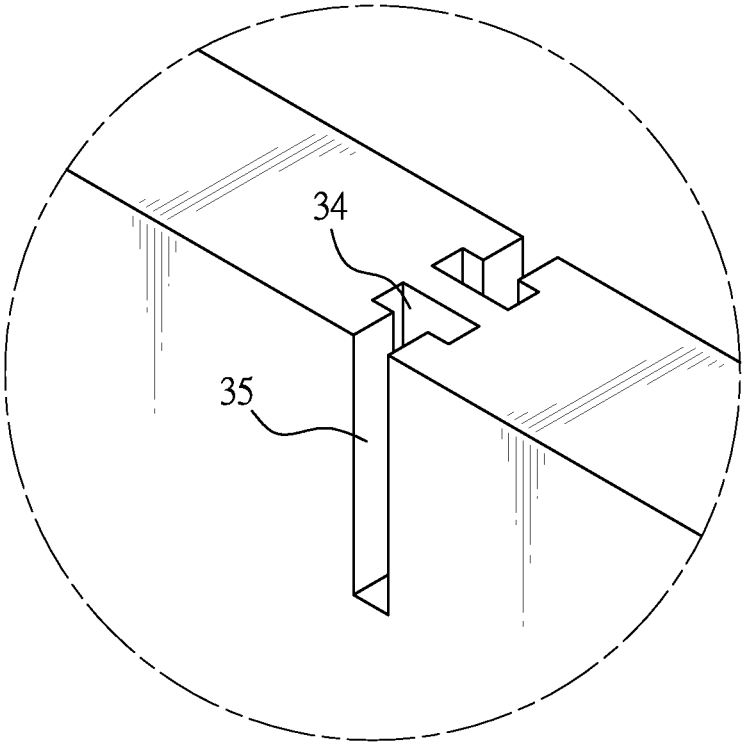
FIG. 9B is an enlarged view of an engaging groove of the supporting portion of the wave-shaped ramp in FIG. 9A.

Then please refer to FIGS. 2, 3, and 7. Part of the engaging protrusions 21 are formed on bottom surfaces of the two first linking ends 201 of the curved platform 20 and protrude downward, and each one of the engaging protrusions 21 is detachably received in a respective one of the engaging grooves 14 of the ascending platforms 10. In this embodiment, the shape of the horizontal section of the engaging groove 14 and that of the engaging protrusion 21 match each other and thereby the engaging protrusions 21 are capable of being engaged in the engaging groove 14. After engaged, the engaging grooves 14 and the engaging protrusions 21 may not have displacement, which secures the ascending platforms 10 and the curved platform 20.

Each one of the engaging protrusions 21 forms a lateral extending piece 211 and a longitudinal extending piece 212. The lateral extending piece 211 and the longitudinal extending piece 212 protrude downward from the bottom surface of the curved platform 20. The lateral extending piece 211 extends in the width direction of the wave-shaped ramp and the longitudinal extending piece 212 extends in the lengthwise direction of the wave-shaped ramp. The longitudinal extending piece 212 is securely mounted on an inner surface of the lateral extending piece 211. In other words, in one of the first linking ends 201, the longitudinal extending piece 212 is closer to the other first linking end 201 than the corresponding lateral extending piece 211, and thereby the engaging protrusion 21 is hard to deform toward the other first linking end 201 and thus structural strength of the engaging protrusion 21 is improved. Besides, each longitudinal extending piece 212 may be connected with a respective one of the ribs 23 and thus the longitudinal extending piece 212 and the rib 23 are integrally made.

The ribs 23 are arranged on the bottom surface of the curved platform 20. Part of the ribs 23 extend in the lengthwise direction of the wave-shaped ramp and the remaining ribs 23 extend in the width direction of the wave-shaped ramp. In other words, the ribs 23 form lattice structures and thereby the structural strengths of the curved platform 20 in the lengthwise direction and the width direction of the wave-shaped ramp are improved.

Then please refer to FIGS. 2, 8 9A and 9B. On the other hand, in this embodiment, the curved platform 20 may be two pieces, but it is not limited thereto, as the curved platform 20 may be one piece or multiple pieces in another embodiment. Precisely, the curved platform 20 comprises two curved portions 20A. One end of each curved portion 20A is the aforementioned first linking end 201 and another end of each curved portion 20A is defined as a second linking end 202. The second linking ends 202 of the two curved portions 20A are connected with each other. In each curved portion 20A, the first linking end 201 is higher than the second linking end 202, so that the curved platform 20 forms varieties in height. Each curved portion 20A comprises a second slope 203. The second slope 203 is a top surface of the curved portion 20A and connects the first linking end 201 and the second linking end 202. A gradient of the second slope 203 at the second linking end 202 is horizontal so that when the two curved portions 20A are connected to each other, the connecting portions thereof form a smooth surface.

In the curved platform 20, part of the engaging protrusions 21 are formed on a bottom surface of the second linking end 202 of each curved portion 20A and protrude downward. In other words, part of the engaging protrusions 21 are formed between the two first linking ends 201. Accordingly, the supporting portion 30 forms multiple engaging grooves 34. Each engaging groove 34 of the supporting portion 30 extends downward from a top surface of the supporting portion 30. In this embodiment, the supporting portion 30 forms multiple slots 35. Each slot 35 is located on two side surfaces of the supporting portion 30 and said side surfaces of the supporting portion 30 respectively face to the two ascending platforms 10. Each one of the slots 35 extends downward from the top surface of the supporting portion 30 and communicates with a respective one of the engaging grooves 34. Technical features of the engaging grooves 34 and the slots 35 of the supporting portion 30 are similar to those of the engaging grooves 14 and the slots 15 of the ascending platform 10.

In this embodiment, each one of the engaging protrusions 21 formed at the second linking end 202 is received in a respective one of the engaging grooves 34 of the supporting portion 30. However, in another embodiment, two of the engaging grooves 34 arranged in the same straight extension line parallel to the lengthwise direction of the wave-shaped ramp may communicate with each other. Therefore, said two engaging grooves 34 form one enlarged groove and thus the two engaging protrusions 34 belong to the different curved portions 20A are capable of being received in the enlarged groove.

Shapes of the engaging protrusion 21 at the second linking end 202 may be the similar to or different from shapes of the engaging protrusions 21 at the first linking end 201. For example, the term "similar" means that horizontal sectional shapes and lengths of the engaging protrusions 21 at the second linking end 202 and at the first linking end 201 shall be the same and other technical features may be different. When the engaging protrusions 21 at the second linking end 202 and at the first linking end 201 are similar as described above, the curved portion 20A not only can engage the ascending platform 10 via the engaging protrusions 21 at the first linking end 201 received in the engaging grooves 14 of the ascending platform 10, thereby providing a wave-shaped ramp varying in height, but also can engage via the engaging protrusions 21 at the second linking end 202 received in the engaging groove 14, thereby providing a wave-shaped ramp with higher height and different gradients. The term "different" means the engaging protrusions 21 at the second linking end 202 and at the first linking end 201 are different in sectional shape and length, so that the engaging protrusions 21 at the second linking end 202 cannot be received in the engaging grooves 14 and/or the engaging protrusions 21 at the first linking end 201 cannot be received in the engaging grooves 34.

Consequently, with the curved platform 20 forming a cavity shape between the two ascending platforms 10, the wave-shaped ramp provides more varieties in height, and thereby the player can perform more fancy stunts on the wave-shaped ramp. Besides, the wave-shaped ramp is a combination of the ascending platforms 10 and the curved platform 20, so the wave-shaped ramp is separable and is capable of being stacked for storage.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A wave-shaped ramp comprising:

two ascending platforms, each one of the ascending platforms comprising:

a ground end;

a tip end higher than the ground end;

a slope being a top surface of the ascending platform and connecting the ground end and the tip end;

a curved platform mounted between the two ascending platforms, and two ends of the curved platform respectively defined as:

two first linking ends connected with the tip ends of the two ascending platforms; the two ends of the curved platform being higher than a middle of the curved platform;

wherein the wave-shaped ramp further comprises:

a plurality of engaging grooves, each of the ascending platforms having at least one of the engaging groove formed thereon; said at least one engaging groove being arranged on a top surface of the tip end of the corresponding ascending platform;

wherein the curved platform comprises:

a plurality of engaging protrusions, part of the engaging protrusions being arranged on bottom surfaces of the two first linking ends of the curved platform and protruding downwardly, said engaging protrusions on the first linking ends being respectively and detachably received in the engaging grooves on the ascending platforms;

wherein the wave-shaped ramp further comprises:

a supporting portion; one end of the supporting portion being securely mounted on a bottom surface of the curved platform, and another end of the supporting portion abutting the ground; part of the engaging grooves being arranged on a top surface of the supporting portion; and wherein part of the engaging protrusions are arranged on the bottom surface of the curved platform and between the two first linking ends; the engaging protrusions between the two first linking ends being respectively and detachably received in the engaging grooves on the supporting portion.

2. The wave-shaped ramp as claimed in claim 1, wherein each one of the engaging protrusions forms:

a lateral extending piece protruding downwardly from the curved platform and extending along a width direction of the wave-shaped ramp; and a longitudinal extending piece protruding downwardly from the curved platform, extending along a lengthwise direction of the wave-shaped ramp, and securely mounted on an inner surface of the lateral extending piece.

3. The wave-shaped ramp as claimed in claim 2, wherein, in each one of the engaging grooves formed on the ascending platforms, a width of a portion of the engaging groove near the ground end of the corresponding ascending platform is wider than a width of another portion of said engaging groove away from said ground end in a lengthwise direction of the wave-shaped ramp.

4. The wave-shaped ramp as claimed in claim 3, wherein each one of the engaging grooves forms:

a first space; and a second space farther from the ground end of the corresponding ascending platform than the first space; a dimension of the second space being larger than that of the first space in the lengthwise direction of the wave-shaped ramp.

5. The wave-shaped ramp as claimed in claim 4, wherein the curved platform forms:

two additional pieces on the two ends of the curved platform; the two additional pieces abutting downwardly of the tip ends of the two ascending platforms respectively, and upper surfaces of the two additional pieces forming smooth surfaces with the top surfaces of the two ascending platforms respectively.

6. The wave-shaped ramp as claimed in claim 5, wherein the curved platform comprises:

two curved portions; one end of each one of the two curved portions being the first linking end, and another end of each one of the two curved portions being defined as a second linking end, the second linking ends of the two curved portions being connected with each other; in each one of the curved portions, the first linking end being higher than the second linking end, and each one of the curved portions comprising:

a second slope being a top surface of the curved portion and connecting with the first linking end and the second linking end.

7. The wave-shaped ramp as claimed in claim 6, wherein the curved platform comprises:

a plurality of ribs on a bottom surface of the curved platform; part of the ribs extending in a lengthwise direction of the wave-shaped ramp, and the remaining ribs extending in a width direction of the wave-shaped ramp.

8. The wave-shaped ramp as claimed in claim 1, wherein, in each one of the engaging grooves formed on the ascending platforms, a width of a portion of the engaging groove near the ground end of the corresponding ascending platform is wider than a width of another portion of said engaging groove away from said ground end in a lengthwise direction of the wave-shaped ramp.

9. The wave-shaped ramp as claimed in claim 8, wherein each one of the engaging grooves forms:

a first space; and a second space farther from the ground end of the corresponding ascending platform than the first space; a dimension of the second space being larger than that of the first space in the lengthwise direction of the wave-shaped ramp.

10. The wave-shaped ramp as claimed in claim 1, wherein the curved platform forms:

two additional pieces on the two ends of the curved platform; the two additional pieces abutting downwardly of the tip ends of the two ascending platforms respectively, and upper surfaces of the two additional pieces forming smooth surfaces with the top surfaces of the two ascending platforms respectively.

11. The wave-shaped ramp as claimed in claim 1, wherein the curved platform comprises:

two curved portions; one end of each one of the two curved portions being the first linking end, and another end of each one of the two curved portions defined as a second linking end, the second linking ends of the two curved portions connected with each other; in each one of the curved portions, the first linking end being higher than the second linking end, and each one of the curved portions comprising:

a second slope being a top surface of the curved portion and connecting with the first linking end and the second linking end.

12. The wave-shaped ramp as claimed in claim 1, wherein the curved platform comprises:

a plurality of ribs on a bottom surface of the curved platform; part of the ribs extending in a lengthwise direction of the wave-shaped ramp, and the remaining ribs extending in a width direction of the wave-shaped ramp.

13. A wave-shaped ramp comprising:

two ascending platforms, each one of the ascending platforms comprising:

a ground end;

a tip end higher than the ground end;

a slope being a top surface of the ascending platform and connecting the ground end and the tip end;

a curved platform mounted between the two ascending platforms, and two ends of the curved platform respectively defined as:

two first linking ends connected with the tip ends of the two ascending platforms; the two ends of the curved platform being higher than a middle of the curved platform;

wherein the curved platform comprises:

two curved portions; one end of each of the two curved portions being the first linking end, and another end of each of the two curved portions being defined as a second linking end, the second linking ends of the two curved portions being connected with each other; the first linking end in each of the curved portions being higher than the second linking end, and each one of the curved portions comprising:

a second slope being a top surface of the curved portion and connecting with the first linking end and the second linking end.

14. A wave-shaped ramp comprising:

two ascending platforms, each one of the ascending platforms comprising:

a ground end;

a tip end higher than the ground end;

a slope being a top surface of the ascending platform and connecting the ground end and the tip end;

a curved platform mounted between the two ascending platforms, and two ends of the curved platform respectively defined as:

two first linking ends connected with the tip ends of the two ascending platforms; the two ends of the curved platform being higher than a middle of the curved platform;

wherein the curved platform comprises:

a plurality of ribs on a bottom surface of the curved platform; part of the ribs extending in a lengthwise direction of the wave-shaped ramp, and the remaining ribs extending in a widthwise direction of the wave-shaped ramp.

* * * * *